US009157343B2

(12) United States Patent
Kobayashi et al.

(10) Patent No.: US 9,157,343 B2
(45) Date of Patent: Oct. 13, 2015

(54) VARIABLE VALVE TIMING CONTROL DEVICE

(71) Applicant: AISIN SEIKI KABUSHIKI KAISHA, Kariya-shi (JP)

(72) Inventors: Masaki Kobayashi, Okazaki (JP); Yoshihiro Kawai, Obu (JP)

(73) Assignee: AISIN SEIKI KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 14/303,849

(22) Filed: Jun. 13, 2014

(65) Prior Publication Data

US 2015/0034033 A1 Feb. 5, 2015

(30) Foreign Application Priority Data

Jul. 30, 2013 (JP) ..... 2013-157757

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01); *F01L 2001/34433* (2013.01)

(58) Field of Classification Search
CPC ..... F01L 1/344; F01L 1/3442; F01L 2001/34433
USPC ..... 123/90.15, 90.17
See application file for complete search history.

(56) References Cited

U.S. PATENT DOCUMENTS 8,322,317 B2 * 12/2012 Suzuki et al. ..... 123/90.17
8,662,039 B2 3/2014 Fischer et al.
2011/0162606 A1 7/2011 Kaneko
2012/0186545 A1 7/2012 Kawamura
2012/0186547 A1 7/2012 Fujiyoshi et al.

(Continued)

FOREIGN PATENT DOCUMENTS

DE 10 2012 200 801 A1 7/2012
EP 2 322 770 A1 5/2011

(Continued)

OTHER PUBLICATIONS

European Search Report issued Jun. 15, 2015, by the European Patent Office, in corresponding European Patent Application No. 14172057.3 (4 pages).

*Primary Examiner* — Ching Chang
(74) *Attorney, Agent, or Firm* — Buchanan Ingersoll & Rooney PC

(57) ABSTRACT

A variable valve timing control device includes a driving side rotation member configured to synchronously rotating with a crankshaft, a driven side rotation member positioned coaxially to the driving side rotation member and integrally rotating with a camshaft, an intermediate lock mechanism selectively switching a locked state and an unlocked state, a first electromagnetic valve arranged at a position coaxial to the driving side rotation member and for controlling an supply and draining of an operation fluid relative to the fluid pressure chamber, a second electromagnetic valve positioned being offset from the position coaxial to the driving side rotation member and for controlling a supply and draining of the operation fluid flowing from the camshaft to the intermediate lock mechanism separately from the first electromagnetic valve, and a pump supplying the operation fluid to the first electromagnetic valve and the second electromagnetic valve.

4 Claims, 4 Drawing Sheets

(56) References Cited

U.S. PATENT DOCUMENTS

| | | | |
|---|---|---|---|
| 2012/0234275 | A1 | 9/2012 | Fischer et al. |
| 2013/0068184 | A1 | 3/2013 | Tada |
| 2014/0083385 | A1 | 3/2014 | Fischer et al. |

FOREIGN PATENT DOCUMENTS

| | | | |
|---|---|---|---|
| EP | 2 500 531 | A1 | 9/2012 |
| JP | 2010-223172 | A | 10/2010 |
| JP | 2012-193731 | A | 10/2012 |

* cited by examiner

VARIABLE VALVE TIMING CONTROL DEVICE

CROSS REFERENCE TO RELATED APPLICATIONS

This application is based on and claims priority under 35 U.S.C. §119 to Japanese Patent Application 2013-157757, filed on Jul. 30, 2013, the entire content of which is incorporated herein by reference.

TECHNICAL FIELD

This disclosure generally relates to a variable valve timing control device.

BACKGROUND DISCUSSION

A known variable valve timing control device includes a driven side rotation member provided coaxially to a driving side rotation member, a fluid pressure chamber defined between the driving side rotation member and the driven side rotation member, and an intermediate lock mechanism for selectively switching a locked state where a relative rotational phase of the driven side rotation member to the driving side rotation member is restrained at an intermediate lock phase positioned between a most advanced angle phase and a most retarded angle phase, and an unlocked state where the restraint is released (e.g., see JP2012-193731A (hereinafter referred to as Patent reference 1) and JP2010-223172A (hereinafter referred to as Patent reference 2).

The variable valve timing control device disclosed in Patent reference 1 includes a first electromagnetic valve (corresponding to a spool, an actuator, and a spring in the reference) for controlling the supplying and draining of the operation fluid to and from the fluid pressure chamber and a second electromagnetic valve (corresponding to a spool, an actuator, and a spring in the reference) for controlling the supplying and draining of the operation fluid from and to the intermediate lock mechanism separately from the first electromagnetic valve. The first electromagnetic valve and the second electromagnetic valve are provided coaxially to the driving side rotation member and the driven side rotation member. The variable valve timing control device disclosed in Patent reference 2 includes a first electromagnetic valve (corresponding to a first switching valve in the reference) for controlling the supplying and draining of the operation fluid to and from the fluid pressure chamber, a second electromagnetic valve (corresponding to a second switching valve in the reference) for controlling the supplying and draining of the operation fluid from and to the intermediate lock mechanism separately from the first electromagnetic valve, and a single pump supplying the operation fluid to the first electromagnetic valve and the second electromagnetic valve. The first electromagnetic valve and the second electromagnetic valve are provided on an axis which is different from an axis of the driving side rotation member and the driven side rotation member and is positioned closer to a camshaft compared to the position of the driving side rotation member and the driven side rotation member relative to the camshaft.

According to the variable valve timing control device disclosed in Patent reference 1 and Patent reference 2, because the switching control for locking and unlocking the intermediate lock mechanism is performed independently from the supplying and draining control of the operation fluid to and from the fluid pressure chamber, the precision for setting the relative rotation phase is assumed to be high.

Notwithstanding, according to the construction disclosed in Patent reference 1, because the first electromagnetic valve and the second electromagnetic valve are provided coaxially to the driving side rotation member and the driven side rotation member, an axial length of the variable valve timing control device is increased. Further, according to the construction disclosed in Patent reference 2, space for mounting the first electromagnetic valve and the second electromagnetic valve and numbers of fluid passages for supplying and draining the operation fluid are required to be provided at a side closer to the camshaft relative to the driving side rotation member and the driven side rotation member. Thus, according to the known variable valve timing control devices, the degree of freedom for the positioning of parts is low because of the positional relations with respect to surrounding components that are placed close to each other.

Because the temperature of the operation fluid is low when starting the engine, adequate fluid volume necessary for unlocking the intermediate lock mechanism and changing the relative rotational phase cannot be ensured. Particularly, according to the construction for supplying the operation fluid to the first electromagnetic valve and the second electromagnetic valve simultaneously as a pump disclosed in Patent reference 2, time is required for unlocking the intermediate lock mechanism and supplying adequate volume of the fluid to the fluid pressure chamber when starting the engine.

A need thus exists for a variable valve timing control device which is not susceptible to the drawback mentioned above.

SUMMARY

In light of the foregoing, the disclosure provides a variable valve timing control device, which includes a driving side rotation member configured to synchronously rotating with a crankshaft of an internal combustion engine, a driven side rotation member positioned coaxially to the driving side rotation member and integrally rotating with a camshaft for opening and closing a valve of the internal combustion engine, a fluid pressure chamber defined between the driving side rotation member and the driven side rotation member, an intermediate lock mechanism selectively switching a locked state where a relative rotational phase of the driven side rotation member relative to the driving side rotation member is retrained at an intermediate lock phase between a most advanced angle phase and a most retarded angle phase, and an unlocked state where the restraint of the relative rotational phase of the driven side rotation member relative to the driving side rotation member is released, a first electromagnetic valve arranged at a position coaxial to the driving side rotation member and the driven side rotation member and for controlling an supply and draining of an operation fluid relative to the fluid pressure chamber, a second electromagnetic valve positioned being offset from the position coaxial to the driving side rotation member and the driven side rotation member and for controlling a supply and draining of the operation fluid flowing from the camshaft to the intermediate lock mechanism separately from the first electromagnetic valve, and a pump supplying the operation fluid to the first electromagnetic valve and the second electromagnetic valve.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
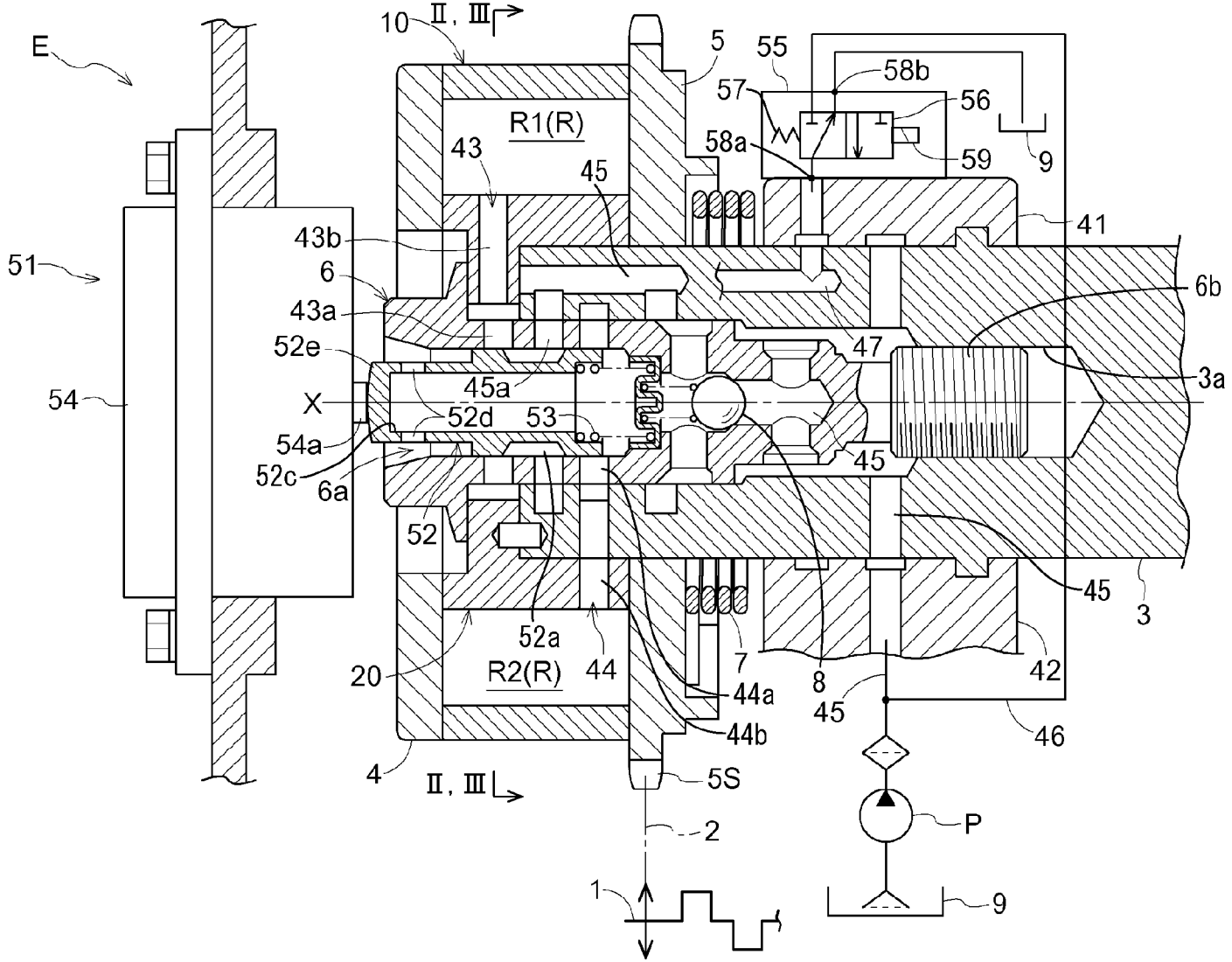
FIG. 1 is a lateral cross-sectional view schematically showing a variable valve timing control device according to a first embodiment disclosed here.

Embodiments of a variable valve timing control device will be explained with reference to illustrations of drawing figures as follows.

Basic structures of the variable valve timing control device according to the first embodiment will be explained with reference to FIGS. 1 and 2. The variable valve timing control device includes an outer rotor 10 serving as a driving side rotation member, an inner rotor 20 serving as a driven side rotation member, and an intermediate lock mechanism L restraining a relative rotation of the outer rotor 10 and the inner rotor 20. The outer rotor 10 synchronously rotates with a crankshaft 1 of an engine E (internal combustion engine) via a power transmitting member 2 (e.g., a timing chain). The inner rotor 20 is connected to a camshaft 3 for opening and closing an intake valve of a combustion chamber of the engine E and is positioned coaxially to a rotation axis X of the outer rotor 10 (i.e., the rotation axis X accords to an axis of the camshaft 3) so as to be relatively rotatable to the outer rotor 10. The intermediate lock mechanism L is structured to selectively switch a locked state (see FIG. 2) where the relative rotational phase of the inner rotor 20 relative to the outer rotor 10 is restrained at an intermediate lock phase between a most retarded angle phase and a most advanced angle phase, and an unlocked state (see FIG. 3) where the restraint at the intermediate lock phase is released.

The outer rotor 10 and the inner rotor 20 are positioned between a front plate 4 which is positioned at a front portion and a rear plate 5 positioned opposite from the front plate 4 (i.e., camshaft 3 side), and are connected by threadedly engaging an oil control valve bolt 6 (hereinafter referred to as the OCV bolt 6) with the camshaft 3. The OCV bolt 6 serves as a fastening member that is inserted into the outer rotor 10 from the front plate 4 side. According to the embodiment, as illustrated in FIG. 1, an oil control valve 51 (hereinafter referred to as the OCV 51) serving as a first electromagnetic valve that functions as a control valve for relative rotation is provided coaxially to the axis X of the camshaft 3. Further, an oil safety valve 55 (hereinafter referred to as the OSV 55) serving as a second electromagnetic valve that functions as a control valve for intermediate lock is provided at a cam cap 41 positioned closer to the camshaft 3 relative to the rear plate 5 at a higher level position compared to the axis X of the camshaft 3. That is, the OSV 55 is provided at the position being offset from, or different from the axis X, and is controlled to supply and drain the operation fluid (e.g., oil) of the camshaft 3 relative to the intermediate lock mechanism L separately from the OCV 51. By positioning the OCV 51 and the OSV 55 as described above, it is not necessary to provide the OCV 51 at an outward of the outer rotor 10. Thus, the axial length and the diameter of the variable valve timing control device can be shortened to downsize the device per se. According to the embodiment, the OSV 55 is arranged in parallel with the axis X (the OSV 55 is arranged along an axis being in parallel with the axis X), however, the construction is not limited to the foregoing. Alternatively, for example, the OSV 55 may be arranged perpendicular to the axis X (the OSV may be arranged along an axis perpendicular to the axis X).

The OCV 51 includes an oil control valve spool 52 (hereinafter referred to as the OCV spool 52), an oil control valve spring 53 (hereinafter referred to as the OCV spring 53) biasing the OCV spool 52, and an electromagnetic solenoid 54 actuating the OCV spool 52. The OSV 55 includes an oil safety valve spool 56 (hereinafter referred as to as the OSV spool 56), an oil safety valve spring 57 (hereinafter referred to as the OSV spring 57) biasing the OSV spool 56, and an electromagnetic solenoid 59 actuating the OSV spool 56. Further, according to the embodiment, the variable valve timing control device includes a single oil pump P actuated by the engine E for supplying the oil sucked from an oil pan 9 to the OCV 51 and the OSV 55. The number of the oil pump P is not limited to one. Alternatively, independent pumps for the OCV 51 and the OSV 55 may be provided.

The OCV spool 52 is housed in an accommodation space **6*a* formed on the OCV bolt 6 in a cup-shape, and is slidable in an axial direction of the axis X inside the accommodation space 6*a*. A male screw portion 6*b* is formed at the OCV bolt 6 and the male screw portion 6*b* is engaged with a female screw portion 3*a* of the camshaft 3 via threads to fix the OCV bolt 6 to the camshaft 3**.

The OCV spring 53 is provided in the accommodation space **6*a* at the camshaft 3 side and constantly biases the OCV spool 52 in a direction opposite from the camshaft 3. Upon feeding, or supplying electricity to the electromagnetic solenoid 54, a push pin 54*a* provided at the electromagnetic solenoid 54 pushes a bottom portion 52*e* of the OCV spool 52. In consequence, the OCV spool 52 moves towards the camshaft 3 side against the biasing force of the OCV spring 53**.

The OCV 51 and the OSV 55 are configured to regulate, or control the position of the spool by regulating, or controlling a duty ratio of the electric power supplied to the electromagnetic solenoids 54, 59. Further, the feeding amount by the OCV 51 and the OSV 55 to the electromagnetic solenoids 54, 59 is controlled by an engine control unit.

Constructions of the driving side rotation member and the driven side rotation member will be explained hereinafter. A sprocket 5S around which the power transmitting member 2, for example, a timing chain, is wound is integrally formed at an outer periphery position of the rear plate 5. A torsion spring 7 biasing the inner rotor 20 towards an advanced angle direction S1 is provided between the rear plate 5 and the camshaft 3.

Figure 2:
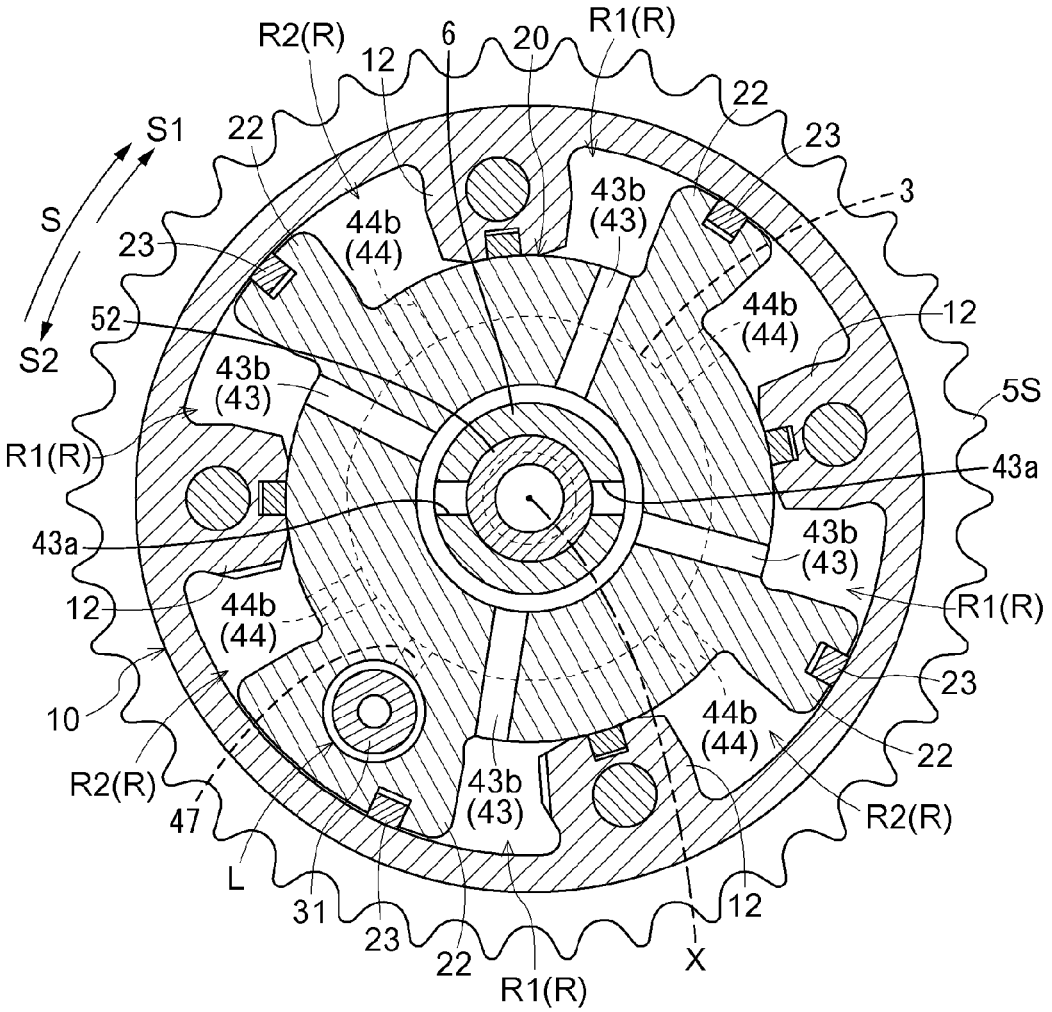
FIG. 2 is a cross-sectional view taken on line II-II in FIG. 1 showing a state where an intermediate lock mechanism is in a locked state.

As illustrated in FIG. 2, plural section portions 12 which protrude in radial directions are formed on the outer rotor 10. The section portions 12 are spaced from each other along a rotational direction S. Thus, fluid pressure chambers (hydraulic chamber) R are defined between the outer rotor 10 and the inner rotor 20. The section portion 12 functions as a shoe relative to an outer periphery surface of the inner rotor 20. Vane portions 22 are formed on an outer periphery surface of the inner rotor 20 at portions facing the fluid pressure chambers R, respectively. The fluid pressure chamber R is divided into an advanced angle chamber R1 and a retarded angle chamber R2 along the rotational direction S. A seal 23 which is in contact with an inner periphery surface of the outer rotor 10 is provided at a protruded end of the vane portion 22. According to the embodiment, four fluid pressure chambers R are provided, however, the construction is not limited to the foregoing.

The outer rotor 10 is actuated to rotate in a direction indicated with S in FIG. 2 by the power transmitting member 2. The advanced angle chamber R1 changes the relative rotational phase of the inner rotor 20 and the outer rotor 10 in an advanced angle direction S1 upon receiving the oil (when the oil is supplied to the advanced angle chamber R1). The retarded angle chamber R2 changes the relative rotational phase of the inner rotor 20 and the outer rotor 10 in a retarded angle direction S2 upon receiving the oil (when the oil is supplied to the retarded angle chamber R2).

By controlling the OCV 51, the oil is supplied to and drained from the advanced angle chamber R1 and the retarded angle chamber R2, or the supply and the drain of the oil is blocked, thus to apply the oil pressure to the vane portion 22. Accordingly, the relative rotational phase is displaced in either the advanced angle direction or the retarded angle direction, or the relative rotational phase is maintained at a predetermined phase. The advanced angle direction indicated with an arrow S1 in FIG. 2 is defined as a direction where the volume of the advanced angle chamber R1 is increased. The retarded angle direction S2 indicated with an arrow S2 in FIG. 2 is defined as a direction where the volume of the retarded angle chamber R2 increases. The relative rotational phase when the volume of the advanced angle chamber R1 is maximized is defined as a most advanced angle phase. The relative rotational phase when the volume of the advanced angle chamber R2 is maximized is defined as a most retarded angle phase.

As illustrated in FIG. 1, the oil sucked from the oil pan 9 by the oil pump P is diverged into an oil supply passage 45 for oil control valve (hereinafter referred to as the oil supply passage 45 for OCV) and an oil supply passage 46 for oil safety valve (hereinafter referred to as the oil supply passage 46 for OSV) to be supplied to the OCV 51 and the OSV 55, respectively.

Structures of the OCV (first electromagnetic valve) will be explained hereinafter. The OCV spool 52 of the OCV 51 is formed in a cylindrical shape having a bottom and an opening that opens at the camshaft 3 side in the axis X direction. The OCV spool 52 includes a supply annular groove 52*a* that is formed over an entire circumference of an outer periphery of the OCV spool 52 and an drain hole 52*d* for draining the oil to the outside. Further, the OCV bolt 6 includes a supply and drain port 43*a* for advanced angle, a supply and drain port 44*a* for retarded angle, and a supply port 45*a*.

An advanced angle oil passage 43 connected to each of the advanced angle chambers R1 includes the supply and drain port 43*a* for advanced angle and a through hole 43*b* for advanced angle formed on the inner rotor 20. Further, a retarded angle oil passage 44 connected to each of the retarded angle chambers R2 includes the supply and drain port 44*a* for retarded angle and a through hole 44*b* for retarded angle formed on the inner rotor 20. Further, the oil supply passage 45 for OCV for supplying the oil to the OCV 51 includes a cylinder head 42, a passage formed on the camshaft 3 and the OCV bolt 6, and the supply port 45*a*. A check valve 8 for preventing the oil that is to be supplied to the supply passage 45 for OCV from flowing in a reverse direction is provided in the accommodation space 6*a* of the OCV bolt 6 at the oil supply passage 45 for OCV. The check valve 8 adopts a known structure.

The oil supplied to the oil supply passage 45 for OCV flows into the supply annular groove 52*a* via the supply port 45*a*. As illustrated in FIG. 1, in a case where the electromagnetic solenoid 54 is not energized, the supply annular groove 52*a* of the OCV spool 52 comes in communication with the supply and drain port 43*a* for advanced angle formed on the OCV bolt 6 by a biasing force of the OCV spring 53, and does not communicate with the supply and drain port 44*a* for retarded angle. Simultaneously, the supply and drain port 44*a* for retarded angle comes in communication with the accommodation space 6*a*. That is, the oil supplied to the supply passage 45 for OCV is supplied to the advanced angle chamber R1 via the advanced angle oil passage 43, and the oil in the retarded angle chamber R2 is drained outside via the retarded angle oil passage 44, the accommodation space 6*a*, and the drain hole 52*d*. In those circumstances, by the oil pressure applied to the advanced angle chamber R1, the relative rotational phase is displaced in the advanced angle direction S1.

When the electromagnetic solenoid 54 is energized by a predetermined amount, or level, the supply annular groove 52*a* of the OCV spool 52 does not communicate with the supply and drain port 43*a* for advanced angle and the supply and drain port 44*a* for retarded angle which are formed on the OCV bolt 6. In those circumstances, because the supply and drain port 43*a* for advanced angle is configured so as not to communicate with a communication hole 52 for draining formed on the OCV spool 52, the oil in the advanced angle chamber R1 is not drained to the outside via the advanced angle oil passage 43, the communication hole 52 for draining, the accommodation space 6*a*, and the drain hole 52*d*. Similarly, in the foregoing circumstances, because the supply and drain port 44*a* for retarded angle is configured so as not to communicate with the accommodation space 6*a*, the oil in the retarded angle chamber R2 is not drained to the outside via the retarded angle oil passage 44, the accommodation space 6*a*, and the drain hole 52*d*. That is, the supply and draining of the oil to and from the advanced angle chamber R1 and the retarded angle chamber R2 is blocked to maintain the relative rotational phase.

When the electromagnetic solenoid 54 is energized maximally, the supply annular groove 52*a* of the OCV spool 52 comes in communication with the supply and drain port 44*a* for retarded angle formed on the OCV bolt 6, and does not communicate with the supply and drain port 43*a* for advanced angle. Simultaneously, the supply and drain port 43*a* for advanced angle communicates with the accommodation space 6*a*. Namely, the oil supplied to the oil supply passage 45 for OCV is supplied to the retarded angle R2 via the retarded angle oil passage 44, and the oil in the advanced angle chamber R1 is drained to the outside via the advanced angle oil passage 43, the accommodation space 6*a*, and the drain hole 52*d*. In those circumstances, by the oil pressure applied to the retarded angle chamber R2, the relative rotational phase is displaced in the retarded angle direction S2.

Figure 3:
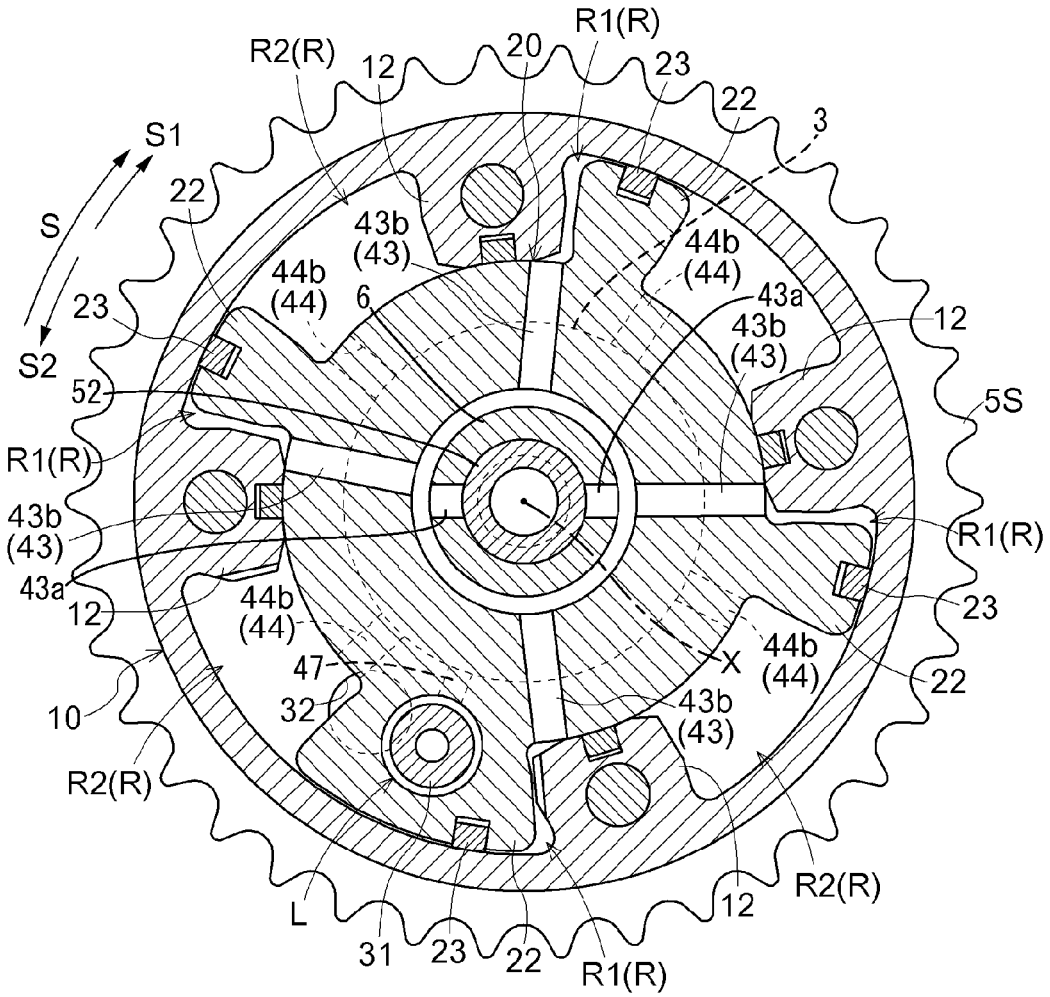
FIG. 3 is a cross-sectional view taken on line III-III in FIG. 1 showing a state where the intermediate lock mechanism is in an unlocked state.

A construction of the intermediate lock mechanism will be explained as follows. As illustrated in FIGS. 2 and 3, the intermediate lock mechanism L includes a lock pin 31 serving as a restricting member that is selectively retractable (selectively inserted) along the axis X relative to one of the plural vane portions 22 formed on the inner rotor 20. The intermediate lock mechanism L includes a lock recessed portion 32 formed on the rear plate 5 and a lock spring biasing the lock pin 31 in an engaging direction. The lock recessed portion 32 is configured to receive and to be engaged with the lock pin 31. According to the embodiment, the lock pin 31 is provided at the vane portion 22 that is formed in a block shape. According to an alternative construction, the vane portion 22 may be formed in a plate shape, the lock pin 31 may be formed at the section portion 12, the lock recessed portion 32 may be formed at the inner rotor 20, and the lock pin 31 may be configured to engage with the lock recessed portion 32 in an orthogonal direction relative to the axis X. Further, the number of the intermediate mechanism is not limited to one.

Alternatively, two or greater number of the intermediate lock mechanisms L may be provided.

The intermediate lock phase is set at a phase around a center between the most retarded angle and the most advanced angle where the engine E operates effectively with favorable fuel efficiency. When the oil is supplied to the intermediate lock mechanism L and an unlocked state is established upon a disengagement of the lock pin 31 from the lock recessed portion 32 after starting the engine E, as illustrated in FIG. 3, the relative rotational phase of the inner rotor 20 relative to the outer rotor 10 can be set as desired. When the engine E is stopped, by changing the relative rotational phase to the intermediate lock phase, the lock pin 31 is moved to be received and engaged with the lock recessed portion 32 to establish the locked state by means of a biasing force of the lock spring.

As illustrated in FIGS. 1 and 3, a supply and drain port 58*a* for intermediate lock of the OSV 55 is positioned at a level higher than the axis X of the camshaft 3. The oil reserved in the oil pan 9 is sucked by a mechanism oil pump P that is actuated in response to being transmitted with the rotational drive force of the crankshaft 1, and is supplied to the oil supply passage 46 for OSV. Thereafter, the oil supplied to the OSV 55 is supplied to the lock recessed portion 32 via a lock passage 47 formed on the camshaft 3 and the inner rotor 20.

The OSV spring 57 is provided at a side of the outer rotor 10 and always biases the OSV spool 56 towards the camshaft 3. When the electromagnetic solenoid 59 is not energized, the supply and drain port 58*a* for intermediate lock comes in communication with an drain port 58*b* by the biasing force of the OSV spring 57. Thus, the oil in the lock recessed portion 32 is drained to the outside.

On the other hand, in a case where the electromagnetic solenoid 59 is energized, the OSV spool 56 moves against the biasing force of the OSV spring 57 so that the supply and drain port 58*a* for intermediate lock comes in communication with the oil supply passage 46 for OSV. Accordingly, the oil supplied to the OSV 55 is supplied to the lock recessed portion 32, and the lock pin 31 is disengaged from the lock recessed portion 32 to establish the unlocked state.

When stopping the engine E, after draining the oil in the lock recessed portion 32 to the outside, by moving, or shifting the relative rotational phase to the intermediate lock phase, by the biasing force of the lock spring, the lock pin 31 is moved to be engaged with the lock recessed portion 32 to established the locked state. In those circumstances, the supply and drain port 58*a* for intermediate lock of the OSV 55 is positioned at a higher level than the lock recessed portion 32 in a most of domain, or region of a rotation stop angle of the outer rotor 10 (a most of range of angle at which the rotation of the outer rotor 10 stops). That is, by a difference in hydraulic head of the intermediate lock mechanism L and the OSV 55, some amount of the oil remains in the lock passage 47. Thus, when the engine E is started at sequential occasion (next time), receiving the output pressure from the oil pump P, the oil remained in the lock passage 47 is swiftly supplied to the lock recessed portion 32. Thus, because the responsivity relative to the intermediate lock mechanism L is high, the relative rotational phase is securely changed.

In a case where the oil is not adequately supplied to the fluid pressure chamber R after the lock is released when starting the engine E, the relative rotational phase cannot be smoothly changed. According to the embodiment, as illustrated in FIG. 1, a flow path dimension, or flow path area of the supply and drain oil passage 45 for OCV, the advanced angle oil passage 43 connecting the OCV 51 and the fluid pressure chamber R, and the retarded angle oil passage 44 connecting the OCV 51 and the fluid pressure chamber R is formed to be greater than a flow path dimension, or flow path area of the lock passage 47 connecting the OSV 55 and the intermediate lock mechanism L. That is, because a resistance (flow path resistance) of the oil supplied from the single oil pump P is reduced at a portion with a relatively greater diameter, greater volume of the oil is supplied to the fluid pressure chamber R in a short period. On the other hand, the lock recessed portion 32 does not require as much oil as the fluid pressure chamber R, thus even if the flow path dimension of the lock passage 47 is reduced, unlocking operation is not interfered, or impeded. Further, because some amount of oil remains in the lock passage 47, the unlocking operation is smoothly operated. Thus, because a diameter of the camshaft 3 can be reduced by the reduction of the diameter of the lock passage 47, the space for positioning the OSV 55 can be ensured in a circumferential direction of the camshaft 3. Thus, changes in the relative rotational phase when starting the engine E can be swiftly performed and the flexibility (degree of freedom) for positioning the OSV 55 is enhanced, thus to provide a downsized variable valve timing control device.

Figure 4:
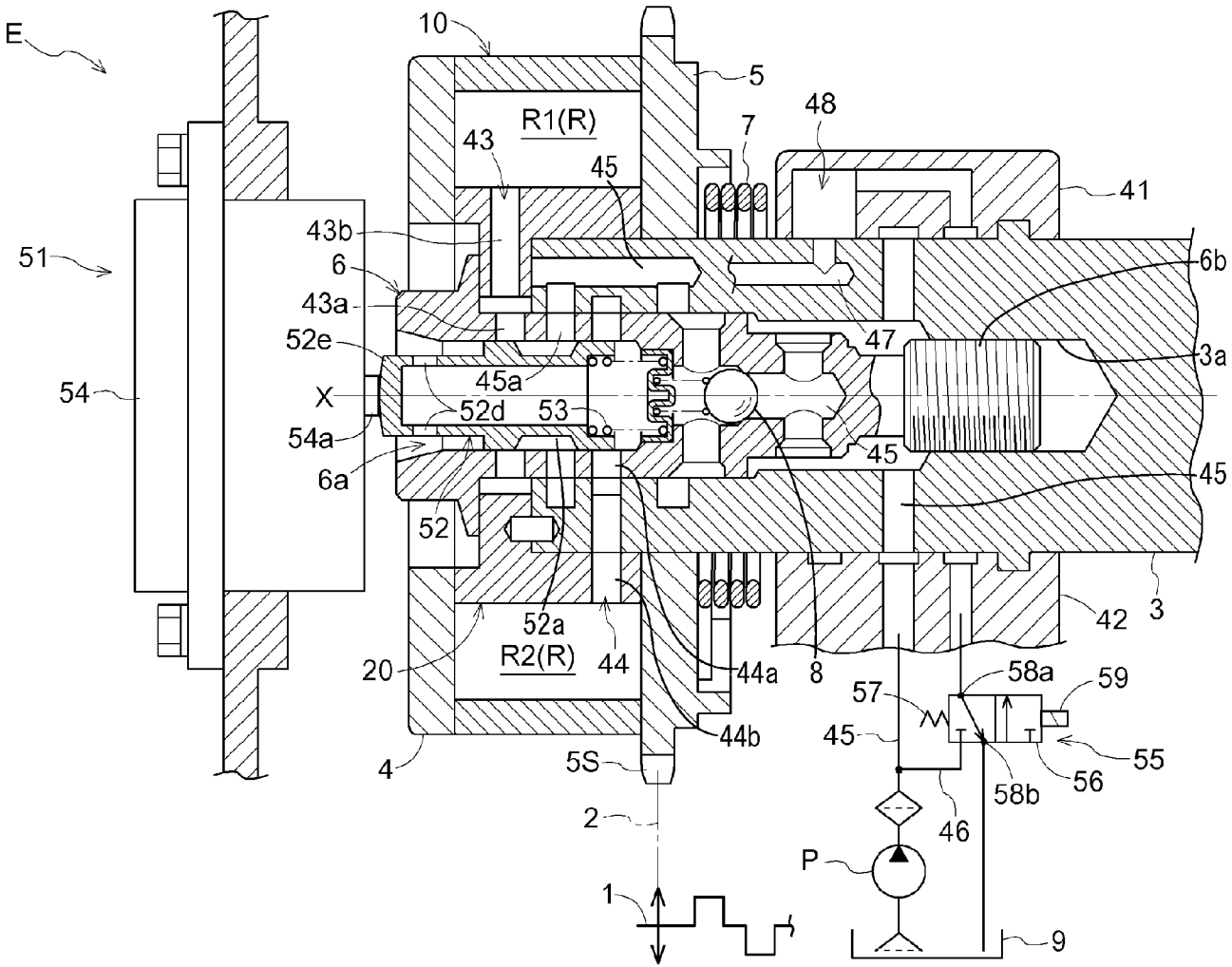
FIG. 4 is a lateral cross-sectional view schematically showing a variable valve timing control device according to a second embodiment disclosed here.

A second embodiment will be explained with reference to FIG. 4. According to the second embodiment, as illustrated in FIG. 4, the OSV 55 may be provided at the cylinder head 42 positioned at a level lower than the axis X of the camshaft 3. According to this construction, by providing a fluid reserve portion 48 formed in a recessed shape at a joining portion between the cam cap 41 and the camshaft 3 to reserve the oil in the lock passage 47, the responsivity to the intermediate lock mechanism L can be enhanced. In a case where there is no need for enhancing the responsivity to the intermediate lock mechanism L, alternatively, the fluid reserve portion 48 may be omitted. Further, alternatively, the fluid reserve portion 48 may be formed at a portion other than the joining portion.

According to the construction of the embodiment, the OCV 51 is provided on the axis X of the camshaft 3 and the OSV 55 is provided at the position offset from the axis X close to the camshaft 3, however, the construction is not limited to the foregoing. Alternatively, the OSV 55 may be provided on the axis X of the camshaft 3 and the OCV 51 may be provided at a position offset from the axis X and at a side close to the camshaft 3. Further, alternatively, the OCV 51 or the OSV 55 arranged at the position offset from the axis X may be positioned at a side close to the front plate 4.

According to the first embodiment, the supply and drain port 58*a* for intermediate lock of the OSV 55 is positioned at a level higher than the axis X of the camshaft 3, however, the construction is not limited to the foregoing structure. Alternatively, the supply and drain port 58*a* for intermediate lock of the OSV 55 may be positioned at a level higher than the highest position of the lock recessed portion 32 in response to the rotation of the outer rotor 10. In those circumstances, irrespective of the stop position of the intermediate lock mechanism L, the oil is securely remained in the lock passage 47.

According to the embodiment, the flow path dimension, or flow path area of the supply and drain oil passage 45 for OCV, the advanced angle oil passage 43, and the retarded angle oil passage 44 are formed relatively greater, however, the construction is not limited to the foregoing structure. Alternatively, a flow path dimension, or flow path area of the advanced angle oil passage 43 and the retarded angle oil passage 44 only may be formed greater than the flow path dimension, or flow path area of the lock passage 47. According to this alternative construction, because a resistance (flow path resistance) is reduced by a degree of an elongated length of a diameter of the advanced angle oil passage 43 and the retarded angle oil passage 44, the greater volume of the oil is supplied to the fluid pressure chamber R in a short period. Further, the diameter of the camshaft 3 can be reduced by a reduced length of the diameter of the supply and drain oil passage 45 for OCV. As long as not disturbing, or not hindering the changes in the relative rotational phase, the flow path dimension, or flow path area of the supply and drain oil passage 45 for OCV, the advanced angle oil passage 43, and the retarded angle oil passage 44 and the flow path dimension, or flow path area of the lock passage 47 may be formed to be substantially the same.

According to the embodiment, the variable valve timing control device controls an opening and closing timing of an intake valve, however, the construction is not limited to the foregoing structure. Alternatively, the variable valve timing control device controls an opening and closing timing of an exhaust valve, or the variable valve timing control device controls an opening and closing timing of an exhaust valve and an intake valve.

According to the embodiment, the section portion 12 is formed on the outer rotor 10 and the vane portion 22 is formed on the inner rotor 20, however, the construction is not limited to the foregoing structure. Alternatively, the vane portion 22 may be formed on the outer rotor 10 and the section portion 12 may be formed on the inner rotor 20.

According to the embodiment, the variable valve timing control device includes the outer rotor 10, the front plate 4, and the rear plate 5, however, the construction is not limited to the foregoing structure. For example, alternatively, the outer rotor 10 and the front plate 4 may be integrally formed to form the outer rotor 10 in a cup shape. Further, alternatively, the outer rotor 10 and the rear plate 5 may be integrally formed.

The variable valve timing control device of the disclosure is applicable to an internal combustion engine for an automobile and for other purposes.

According to the embodiment, a variable valve timing control device includes a driving side rotation member (10) configured to synchronously rotating with a crankshaft (1) of an internal combustion engine (E), a driven side rotation member (20) positioned coaxially to the driving side rotation member (10) and integrally rotating with a camshaft (3) for opening and closing a valve of the internal combustion engine (E), a fluid pressure chamber (R) defined between the driving side rotation member (10) and the driven side rotation member (20), an intermediate lock mechanism (L) selectively switching a locked state where a relative rotational phase of the driven side rotation member (20) relative to the driving side rotation member (10) is retrained at an intermediate lock phase between a most advanced angle phase and a most retarded angle phase, and an unlocked state where the restraint of the relative rotational phase of the driven side rotation member (20) relative to the driving side rotation member (10) is released, a first electromagnetic valve (51) arranged at a position coaxial to the driving side rotation member (10) and the driven side rotation member (20) and for controlling an supply and draining of an operation fluid relative to the fluid pressure chamber (R), a second electromagnetic valve (55) positioned being offset from the position coaxial to the driving side rotation member (10) and the driven side rotation member (20) and for controlling a supply and draining of the operation fluid flowing from the camshaft (3) to the intermediate lock mechanism (L) separately from the first electromagnetic valve (51), and a pump (P) supplying the operation fluid to the first electromagnetic valve (51) and the second electromagnetic valve (55).

According to the construction of the disclosure, by providing the construction separately controlling the first electromagnetic valve (OCV 51) and the second electromagnetic valve (OSV 55), the operation fluid is supplied to and drained from the intermediate lock mechanism (L) without being affected by the fluctuation of the hydraulic pressure in the fluid pressure chamber (R). Thus, a setting precision for a relative rotational phase of the driving side rotation member (outer rotor 10) and the driven side rotation member (inner rotor 20) is assumed to be high.

According to a construction where a first electromagnetic valve (OCV 51) and a second electromagnetic valve (OSV 55) are provided independently from each other, space for positioning the first and second electromagnetic valves (OCV 51, OSV 55) is limited at an internal combustion engine (engine E) around which various components are positioned close to one another. According to the construction of the disclosure, because the first electromagnetic valve (OCV 51) is positioned coaxially to the driving side rotation member (outer rotor 10) and the driven side rotation member (inner rotor 20), the first electromagnetic valve (OCV 51) is, for example, inserted into a fixing member fixing a camshaft (3) and the driven side rotation member (inner rotor 20). Accordingly, compared to a construction where the first electromagnetic valve (OCV 51) and the second electromagnetic valve (OSV 55) are provided coaxially to the driving side rotation member (outer rotor 10) and the driven side rotation member (inner rotor 20), an axial length can be reduced.

According to the construction of the disclosure, the second electromagnetic valve (55) only among the first and second electromagnetic valves (OCV 51, OSV 55) is positioned being offset from the axis of the first electromagnetic valve (OCV 51), that is, being offset from the axis (X) of the driving side rotation member (outer rotor 10) and the driven side rotation member (inner rotor 20). Thus, compared to a known construction in which the first electromagnetic valve (OCV 51) and the second electromagnetic valve (OSV 55) are provided on axes different from the axis for the driving side rotation member (outer rotor 10) and the driven side rotation member (inner rotor 20), a diameter of the device can be reduced. Accordingly, because the variable valve timing control device is downsized by reducing the axial length and the diameter, designing layout of various components mounted to a vehicle is assumed to be easy.

According to the embodiment, the second electromagnetic valve (55) includes a supply and drain port (58*a*) positioned at a level higher than a position of an axis of the camshaft (3).

According to the construction of the disclosure, by providing the supply and drain port (58*a*) of the second electromagnetic valve (OCV 55) at the level higher than the axis of the camshaft (3), even if the position of the intermediate lock mechanism (L) changes, or fluctuates in a circumferential direction in response to the rotation of the driving side rotation member (outer rotor 10), the supply and drain port (58*a*) is positioned at the level higher than the intermediate lock mechanism (L) in a most of domain, or region. That is, when the engine stops, the operation fluid is likely to remain in the fluid passage between the supply and drain port (58*a*) of the second electromagnetic valve (OSV 55) and the intermediate lock mechanism (L) by a difference in hydraulic head of the second electromagnetic valve (OSV 55) and the intermediate lock mechanism (L). Accordingly, because the time, or period for supplying the operation fluid to the intermediate lock mechanism (L) is shortened, the responsivity to unlocking operation of the relative rotational phase restrained at the intermediate lock phase is enhanced and the relative rotational phase is securely changed, or shifted.

According to the embodiment, the pump (P) corresponds to a single pump supplying the operation fluid to the first electromagnetic valve (51) and the second electromagnetic valve (55), and a flow path dimension of a first passage (43, 44) connecting the first electromagnetic valve (51) and the fluid pressure chamber (R) is greater than a flow path dimension of a second passage (47) connecting the second electromagnetic valve (55) and the intermediate lock mechanism (L).

A volume of the fluid to be supplied to the fluid pressure chamber necessary for changing the relative rotational phase is increased by a volume of the fluid pressure chamber compared to a volume of the fluid to be supplied to the intermediate lock mechanism necessary for the unlocking operation. That is, in a case where the operation fluid is not adequately supplied to the fluid pressure chamber after the unlocking operation when starting the engine, the relative rotational phase is not changed, or shifted smoothly. However, according to the construction of the disclosure, because the flow path dimension of the first passage (advanced angle chamber 43, retarded angle chamber 44) to which relatively greater volume of the fluid is supplied and necessary is structured to be greater than a flow path dimension of the second passage (lock passage 47), the resistance in the passage is reduced and greater volume of the fluid supplied to the fluid pressure chamber can be ensured. Accordingly, the volume of the fluid supplied to the fluid pressure chamber (R) and the intermediate lock mechanism (L) is optimized in accordance with the necessary flow volume, or necessary volume of the fluid to be supplied, and the relative rotational phase can be changed, or shifted swiftly after the unlocking operation.

According to the embodiment, the variable valve timing control device includes a cap (41) attached to the camshaft (3). Further, the second electromagnetic valve (55) is positioned at a level lower than an axis of the camshaft (3). The camshaft (3) includes a second passage (47) connecting the intermediate lock mechanism (L) and the second electromagnetic valve (55). The cap (41) includes a reserve portion (48) covering an opening portion of the second passage (47) and reserving the operation fluid.

According to the construction of the disclosure, the responsivity relative to the intermediate lock mechanism (L) is enhanced, and the relative rotational phase is securely changed.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A variable valve timing control device, comprising:

a driving side rotation member configured to synchronously rotating with a crankshaft of an internal combustion engine;

a driven side rotation member positioned coaxially to the driving side rotation member and integrally rotating with a camshaft for opening and closing a valve of the internal combustion engine;

a fluid pressure chamber defined between the driving side rotation member and the driven side rotation member;

an intermediate lock mechanism selectively switching a locked state where a relative rotational phase of the driven side rotation member relative to the driving side rotation member is retrained at an intermediate lock phase between a most advanced angle phase and a most retarded angle phase, and an unlocked state where the restraint of the relative rotational phase of the driven side rotation member relative to the driving side rotation member is released;

a first electromagnetic valve arranged at a position coaxial to the driving side rotation member and the driven side rotation member and for controlling an supply and draining of an operation fluid relative to the fluid pressure chamber;

a second electromagnetic valve positioned being offset from the position coaxial to the driving side rotation member and the driven side rotation member and for controlling a supply and draining of the operation fluid flowing from the camshaft to the intermediate lock mechanism separately from the first electromagnetic valve; and a pump supplying the operation fluid to the first electromagnetic valve and the second electromagnetic valve.

2. The variable valve timing control device according to claim 1, wherein the second electromagnetic valve includes a supply and drain port positioned at a level higher than a position of an axis of the camshaft.

3. The variable valve timing control device according to claim 1, wherein the pump corresponds to a single pump supplying the operation fluid to the first electromagnetic valve and the second electromagnetic valve; and a flow path dimension of a first passage connecting the first electromagnetic valve and the fluid pressure chamber is greater than a flow path dimension of a second passage connecting the second electromagnetic valve and the intermediate lock mechanism.

4. The variable valve timing control device according to claim 1, further comprising:

a cap attached to the camshaft; wherein the second electromagnetic valve is positioned at a level lower than an axis of the camshaft;

the camshaft includes a second passage connecting the intermediate lock mechanism and the second electromagnetic valve; and the cap includes a reserve portion covering an opening portion of the second passage and reserving the operation fluid.

* * * * *